US007240905B1

(12) United States Patent
Stahl, Sr.

(10) Patent No.: US 7,240,905 B1
(45) Date of Patent: Jul. 10, 2007

(54) METHOD AND APPARATUS FOR SEALING A JOINT GAP BETWEEN TWO INDEPENDENTLY MOVABLE STRUCTURAL SUBSTRATES

(75) Inventor: James P. Stahl, Sr., Stockton, NJ (US)

(73) Assignee: Specified Technologies, Inc., Somerville, NJ (US)

( * ) Notice: Subject to any disclaimer, the term of this patent is extended or adjusted under 35 U.S.C. 154(b) by 0 days.

(21) Appl. No.: 10/461,813

(22) Filed: Jun. 13, 2003

(51) Int. Cl.
*E04B 1/94* (2006.01)
*E04B 1/68* (2006.01)
*F16J 15/12* (2006.01)

(52) U.S. Cl. ..... 277/652; 277/654; 277/933; 52/396.01; 52/317; 52/393

(58) Field of Classification Search ..... 277/650, 277/651, 652, 654, 931, 933; 52/393, 396.04, 52/396.01, 273, 317
See application file for complete search history.

(56) References Cited

U.S. PATENT DOCUMENTS

| | | | | | |
|---|---|---|---|---|---|
| 378,604 | A | * | 2/1888 | Kramer | 91/12 |
| 1,357,713 | A | | 11/1920 | Lane | |
| 3,286,422 | A | * | 11/1966 | Pangerl | 52/288.1 |
| 3,331,294 | A | | 7/1967 | Waller | |
| 3,435,574 | A | * | 4/1969 | Hallock | 52/278 |
| 3,447,273 | A | * | 6/1969 | Thom | 52/58 |
| 3,694,976 | A | * | 10/1972 | Warshaw | 52/58 |
| 3,919,820 | A | * | 11/1975 | Green | 52/396.04 |
| 4,566,242 | A | | 1/1986 | Dunsworth | |
| 4,601,475 | A | * | 7/1986 | Nicholson | 277/560 |
| 4,616,460 | A | * | 10/1986 | Nicholas | 277/644 |
| 4,746,129 | A | * | 5/1988 | Puccio | 277/641 |
| 4,811,529 | A | * | 3/1989 | Harris et al. | 52/396.01 |
| 4,967,527 | A | | 11/1990 | Gohlke | |
| 4,977,719 | A | | 12/1990 | LaRoche et al. | |
| 4,999,962 | A | | 3/1991 | Gohlke et al. | |
| 5,029,423 | A | | 7/1991 | Kornylak | |
| 5,140,797 | A | | 8/1992 | Gohlke et al. | |
| 5,251,917 | A | * | 10/1993 | Chee et al. | 277/645 |
| 5,259,162 | A | | 11/1993 | Nicholas | |
| 5,263,293 | A | | 11/1993 | Gohlke et al. | |
| 5,269,624 | A | * | 12/1993 | Kramer | 404/64 |
| 5,297,372 | A | | 3/1994 | Nicholas | |
| 5,365,713 | A | * | 11/1994 | Nicholas et al. | 52/573.1 |
| 5,461,838 | A | | 10/1995 | Heller | |
| 5,560,165 | A | | 10/1996 | Hoefsloot et al. | |
| 5,560,166 | A | | 10/1996 | Burke et al. | |
| 5,755,066 | A | | 5/1998 | Becker | |
| 5,765,332 | A | | 6/1998 | Landin et al. | |
| 5,887,400 | A | | 3/1999 | Bratek et al. | |
| 5,913,788 | A | | 6/1999 | Herren | |

(Continued)

*Primary Examiner*—Alison K. Pickard
(74) *Attorney, Agent, or Firm*—Sperry, Zoda & Kane

(57) ABSTRACT

A system for sealing a joint gap between structural substrate panels such as walls, ceiling and floors making use of a sealing member including a mounting section fixedly secured to one of the surfaces and a covering member extending outwardly therefrom into contact with the other substrate member. These walls, ceilings and floors can be movable relative to one another and thus the present invention provides a mechanism for sealing the joint gap between the substrates while allowing them to move with respect to one another. This is achieved by fixedly securing the sealing member to one of the substrates and urging it into abutting engagement with respect to the other substrate.

18 Claims, 4 Drawing Sheets

U.S. PATENT DOCUMENTS 5,921,041 A 7/1999 Egri, II
5,974,750 A 11/1999 Landin et al.
6,058,668 A 5/2000 Herren
6,112,488 A 9/2000 Olson et al.
6,128,874 A 10/2000 Olson et al.
6,131,352 A 10/2000 Barnes et al.
6,176,053 B1 1/2001 St. Germain
6,183,575 B1 * 2/2001 Embelton ..... 156/71
6,345,480 B1 * 2/2002 Kemper et al. ..... 52/395
6,751,919 B2 * 6/2004 Calixto ..... 52/573.1

* cited by examiner

METHOD AND APPARATUS FOR SEALING A JOINT GAP BETWEEN TWO INDEPENDENTLY MOVABLE STRUCTURAL SUBSTRATES

BACKGROUND OF THE INVENTION

1. Field of the Invention

The present invention deals with the field of devices for sealing the joint gaps between substrate surfaces used structurally. These joint gaps normally occur between floors and walls or between ceilings and walls or between walls. However, such gaps can occur between any two construction substrates.

The primary problem here is that these individual substrates which are normally positioned at an angle with one another and normally at approximately a ninety degree angle with respect to one anther are capable of moving independently of one another. Thus the size of the joint gap can vary significantly as the wall, ceiling or floor flexes relative to the adjacently positioned similar surface. Heretofore the means for sealing such areas has been to insert an insulation batting or to spray foam into the joint gap. The problem is that as the two adjacent substrates move or otherwise flex with respect to one another the size of the gap becomes greater and becomes smaller at various times depending on the type of use and other conditions. When the joint gap widens with some materials the gap becomes too wide for the insulating or blocking material and sealing of the joint gap is compromised. On the other hand when the substrates flex toward one another the amount of this flexing is limited by the minimum width to which the batting or foam can be compressed without failure. Thus these unique conditions experienced by two movable substrates adjacently positioned to define a joint gap therebetween are greatly inhibited by the current means for sealing of the gap. The present invention provides a means for sealing of this gap without requiring the positioning of any component directly in the gap and in this way allows complete capability of flexible movement between the two substrates while maintaining an uncompromised seal extending over the joint gap therebetween.

2. Description of the Prior Art

Many patents have been granted on systems for providing interfacing structure between walls, ceilings and/or floors many of which are defined as "head-of-wall" control system. Other currently existing patents attempting to solve this problem or dealing peripherally with structures for sealing between structural substrates are shown in the following patents. See U.S. Pat. No. 1,357,713 patented Nov. 2, 1920 to A. M. Lane and assigned to Monarch Metal Products Company on a "Weather Strip For Expansion Joints"; and U.S. Pat. No. 3,331,294 patented Jul. 18, 1967 to R. A. Waller and assigned to Kins Developments Limited on a "Flexible Insert"; and U.S. Pat. No. 4,566,242 patented. Jan. 28, 1986 to C. L. Dunsworth and assigned to Metalines, Inc. on a "Smoke And Heat Barrier"; and U.S. Pat. No. 4,967,527 patented Nov. 6, 1990 to H. J. Gohlke and assigned to Metalines, Inc. on "Expansion Joint Fire Barrier Systems"; and U.S. Pat. No. 4,977,719 patented Dec. 18, 1990 to A. R. LaRoche et al on a "Fire Resistant Expansion Joint"; and U.S. Pat. No. 4,999,962 patented Mar. 19, 1991 to H. J. Gohlke et al and assigned to Metalines, INc. on "Expansion Joint Fire Barrier Systems"; and U.S. Pat. No. 5,029,423 patented Jul. 9, 1991 to A. T. Kornylak and assigned to Kornylak Corporation on a "Vibration Resistant Building Construction"; and U.S. Pat. No. 5,140,797 patented Aug. 25, 1992 to H. J. Gohlke et al and assigned to Balco, Inc. on "Expansion Joint Fire Barrier Systems"; and U.S. Pat. No. 5,259,162 patented Nov. 9, 1993 to J. D. Nicholas and assigned to Pawling Corporation on "Multi-Functional Wall Cover For Architectural Joints"; and U.S. Pat. No. 5,263,293 patented Nov. 23, 1993 to H. J. Gohlke et al and assigned to Balco, Inc. on "Expansion Joint Fire Barrier Systems"; and U.S. Pat. No. 5,297,372 patented Mar. 29, 1994 to J. D. Nicholas and assigned to Pawling Corporation on "Elastomeric Sealing System For Architectural Joints"; and U.S. Pat. No. 5,461,838 patented Oct. 31, 1995 to P. S. Heller on a "Fire Barrier"; and U.S. Pat. No. 5,560,165 patented Oct. 1, 1996 to L. Hoefsloot et al and assigned to KONE Oy on "Joint Between A Landing Door And Wall Structures"; and U.S. Pat. No. 5,560,166 patented Oct. 1, 1996 to J. Burke et al and assigned to Foster Wheeler Energia Oy on an "Expansion Joint With Protective Shielding"; and U.S. Pat. No. 5,755,066 patented May 26, 1998 to D. W. Becker on a "Slip Track Assembly"; and U.S. Pat. No. 5,765,332 patented Jun. 16, 1998 to H. V. Landin et al and assigned to Minnesota Mining and Manufacturing Company on a "Fire Barrier Protected Dynamic Joint"; and U.S. Pat. No. 5,887,400 patented Mar. 30, 1999 to D. J. Bratek et al and assigned to Watson Bowman Acme Corp. on an "Expansion Control System"; and U.S. Pat. No. 5,913,788 patented Jun. 22, 1999 to T. r. Herren on a "Fire Blocking And Seismic Resistant Wall Structure"; and U.S. Pat. No. 5,921,041 patented Jul. 13, 1999 to J. D. Egri, II on a "Bottom Track For Wall Assembly"; and U.S. Pat. No. 6,058,668 patented May 9, 2000 to t. R. Herren on a "Seismic And Fire-Resistant Head-Of-Wall Structure"; and U.S. Pat. No. 5,974,750 patented Nov. 2, 1999 to H. V. Landin et al and assigned to 3M Innovative Properties Company on a "Fire Barrier Protected Dynamic Joint"; and U.S. Pat. No. 6,112,488 patented Sep. 5, 2000 to J. R. Olson et al and assigned to Unifrax Corporation on "Fire Barrier Material And Gaskets Therefor"; and U.S. Pat. No. 6,128,874 patented Oct. 10, 2000 to J. R. Olson et al and assigned to Unifrax Corporation and Construction Specialties, Inc. on "Fire Resistant Barrier For Dynamic Expansion Joints"; and U.S. Pat. No. 6,131,352 patented Oct. 17, 2000 to V. Barnes et al on a "Fire Barrier"; and U.S. Pat. No. 6,176,053 patented Jan. 23, 2001 to R. C. A. St. Germain and assigned to roger C. A. St. Germain on a "Wall Track Assembly And Method For Installing The Same".

SUMMARY OF THE INVENTION

The present invention provides a joint sealing means which can be positioned extending a joint gap defined between a first structural substrate and a second structural substrate which are independently movable with respect to one another and adjacently positioned. The joint sealing system includes a sealing member which is flexible and preferably flexibly resilient and is preformed into predetermined shape. This sealing member includes a mounting section adapted to be attached with respect to a first structural substrate for sealing engagement with it. The sealing member also includes a covering section attached to the mounting section and extending outwardly therefrom and formed integrally with the mounting section. The covering section is flexibly resilient and is preformed into a predetermined shape and is adapted to extend from the mounting section outwardly toward the second structural substrate to be urged into abutting engagement therewith to facilitate sealing engagement against it even during independent relative movement between the two substrates.

These two substrates normally comprise a wall and a floor or a ceiling and a floor or two walls which are adjacently positioned and normally angularly oriented with respect to one another and usually are approximately perpendicular with respect to one another. These common structural or construction substrates often are independently movable and need to have a flexible means for maintaining a seal therebetween at all times while allowing normal relative movement therebetween.

The joint sealing system preferably also includes a means of securement for fixedly securing the mounting section of the sealing member with respect to the first structural substrate. This can comprise an adhesive applied between the first substrate and the mounting section of the sealing member or can be nailed or staple driven through the covering section into the first substrate. Any means of securement which will hold the mounting section of the sealing member fixedly with respect to the first structural substrate would be usable.

A scrim material layer may be included extending over the mounting section and the covering section of the sealing member for aiding in the sealing of the joint gap. This scrim preferably is affixed to the mounting and the covering section of the sealing member preferably on the exposed surface thereof. The scrim preferably extends over the mounting section and beyond the covering section by the forming of an extended scrim section which will actually extend beyond the covering section and can lay over a portion of the second substrate. This scrim will significantly reinforce the mounting section and the covering section of the sealing member. Also, however, the scrim material layer can be used for facilitating the adhering of a seal enhancing coating applied thereover. This seal enhancing coating can have an intumescent component or can be a more conventional sealing material. Such a coating of seal enhancing material can be applied such as by spraying over the exposed outer surface of the mounting section as well as the covering section of the sealing member and also can extend over the adjacent areas of the first and second substrate for further facilitating sealing thereof. Adherence between the sealing member and the seal enhancing layer when sprayed can be significantly increased by the use of a scrim material layer secured to the sealing member, especially the extended scrim portion which can facilitate the interface between the area of engagement of the sealing member with respect to the first end or second substrate by allowing the sprayed coat to extend over this interface for maintaining engagement therebetween. A further smooth transition can be achieved by the more gradual contour provided by the inclusion of the extended scrim section. This seal enhancing layer can be any type of normal spray type caulking but could, optionally, include an intumescent component which would facilitate sealing of the joint gap in response to high heat conditions such as during a fire.

The system is utilized by initially providing of the sealing member with the mounting section and a flexibly resilient covering section adjacently secured thereto and then placing of this in abutment with respect to the second substrate. The flexibly resilient covering section is then compressed against the second substrate and the mounting section of the sealing member is affixed to the first substrate while in this flexed condition to thereby maintain firm securement between the first substrate and the mounting section and a biased or compressed engagement of the covering section with respect to the second substrate. Thereafter an intumescent or non-intumescent coating can be applied by spray or otherwise over the entire sealing member and the immediately adjacent sections of the first and second structural substrate.

It is an object of the present invention to provide a means for sealing of the joint gap between adjacently positioned walls, floors and/or ceilings and other structural substrates wherein independent movement of the adjacently positioned substrates is possible without compromising the seal.

It is an object of the present invention to provide a means for sealing of the joint gap between adjacently positioned walls, floors and/or ceilings and other structural substrates wherein changes in the size of the joint by movement of one or both of the substrates does not in any way compromise the integrity of the sealing system extending thereover.

It is an object of the present invention to provide a means for sealing of the joint gap between adjacently positioned walls, floors and/or ceilings and other structural substrates wherein ease of installation is a primary consideration.

It is an object of the present invention to provide a means for sealing of the joint gap between adjacently positioned walls, floors and/or ceilings and other structural substrates wherein repair is easy.

It is an object of the present invention to provide a means for sealing of the joint gap between adjacently positioned walls, floors and/or ceilings and other structural substrates wherein no insulating material need to be placed directly into the joint gap to thereby provide a more flexible interconnecting sealing mechanism.

It is an object of the present invention to provide a means for sealing of the joint gap between adjacently positioned walls, floors and/or ceilings and other structural substrates wherein initial cost capital outlay is minimized.

It is an object of the present invention to provide a means for sealing of the joint gap between adjacently positioned walls, floors and/or ceilings and other structural substrates wherein labor costs and time for installation are minimized.

It is an object of the present invention to provide a means for sealing of the joint gap between adjacently positioned walls, floors and/or ceilings and other structural substrates wherein maintenance is generally minimal.

It is an object of the present invention to provide a means for sealing of a joint gap between adjacently positioned walls, floors and/or ceilings and other structural substrates which is securable to one of the surfaces rather than being positioned in the joint itself and in this manner to allow for complete compression in the joint if needed.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
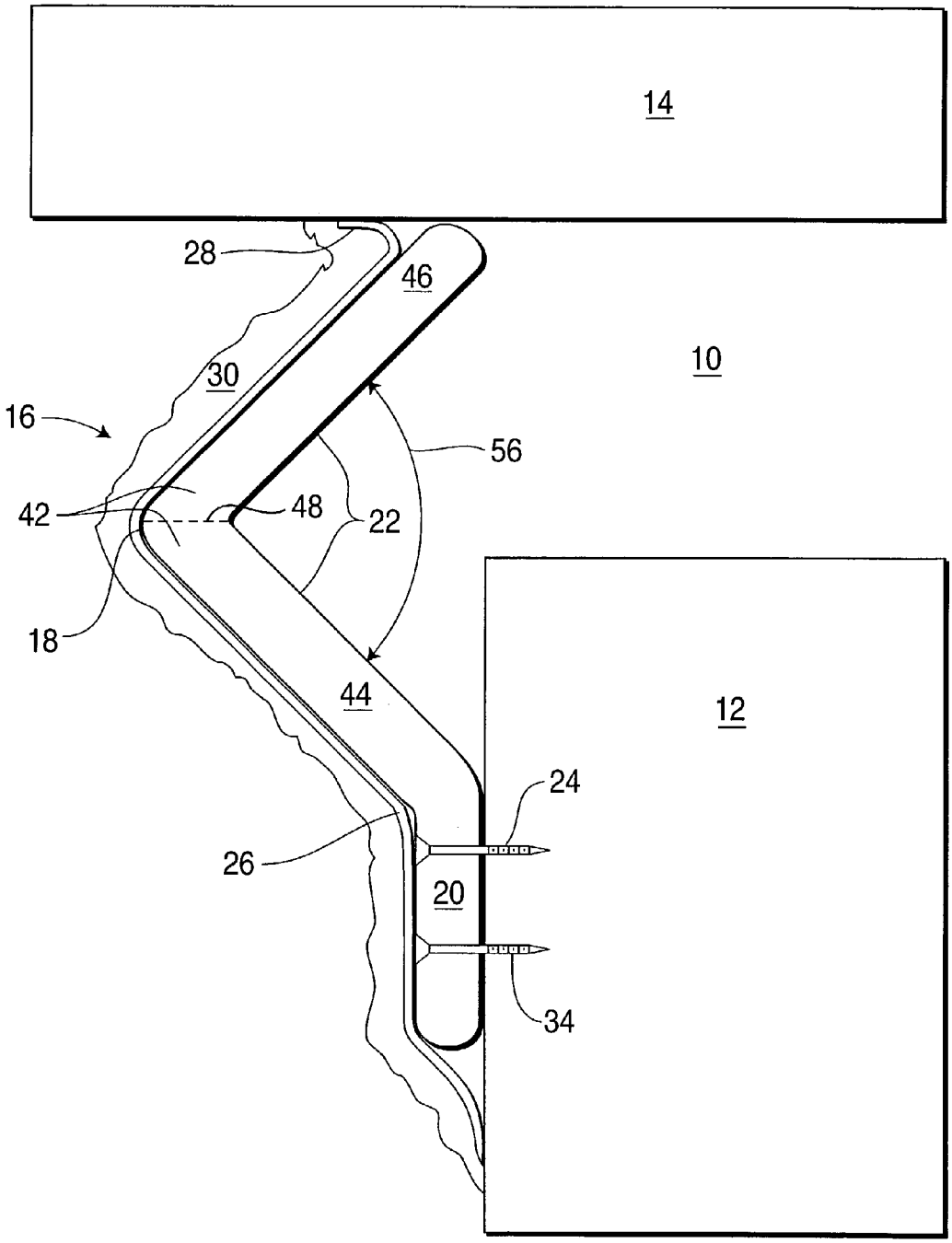
FIG. 1 is a side plan view of an embodiment of the joint sealing means of the present invention showing a V-shaped covering section.

The present invention provides a unique configuration for sealing of the joint gap often defined between walls, ceilings and floors. Such walls, ceiling and floors are referred to in the patent application as structural substrates since they define generally planar surfaces which are immediately adjacent to adjacent similar surfaces normally at an angular orientation with respect to one another while defining a gap in the joint therebetween. The present invention provides a means for sealing of these joint gaps 10 often found in such locations between the first substrates 12 and the second substrates 14. These designs have particular application to head-of-wall configurations wherein the top of a vertically extending wall will define a joint gap 10 between it and a ceiling thereabove. However the joint sealing system of the present invention is usable sealing any type of joint gap between any two structural substrates.

Such substrates are often movable independently of one another. For example, a floor will flex while a wall substrate therebelow or thereabove may remain stationary. Thus the size of the joint gap 10 between the two substrates 12 and 14 can vary significantly over time as the individual substrates separately or independently move, flex and/or expand.

The joint sealing means 16 of the present invention includes a sealing member having two sections. The first portion is a mounting section 20 designed to be fixedly secured with respect to the first substrate 12. It also includes a covering section 22 which is preferably formed integrally with the mounting section and can have various preformed shapes as shown in the present invention such as the U-shaped covering section 36 or the V-shaped covering section 42 or the bellows covering section 50 or any other usable design.

Either the shape or the material of which the covering section 22 is made will preferably define it to be in some manner flexibly resilient such that it can be biased into contact in engagement with respect to the second substrate 14. Once the covering member 22 is biased or forced into contact with second substrate 14 the mounting section 20 of the sealing member 18 can be secured to the first substrate 12 securely. Thus the sealing member 18 in this position will be flexibly biased into sealing engagement with the second substrate 14 while being fixedly secured in its attachment or mounting of the mounting section 20 thereof upon the first substrate 12. In this manner as the joint flexes the sealing member 18 will move with the first substrate 12 and the covering section 22 thereof will be maintained in contact with respect to the second substrate 14 despite the fact that the joint gap 10 itself may become wider or narrower due to the independent movement between the two substrates. It should be appreciated that the first substrate could be a floor, wall or ceiling and the second substrate could also be a floor, wall or ceiling. However the most common situation addressed by this type of sealing system would be where the first substrate 12 is a vertically extending wall and the second substrate 14 is the ceiling portion of horizontally extending floor area.

A securement means 24 will be included for attaching of the mounting section 20 with respect to the first substrate 12. The securement means 24 can include any type of an attaching mechanism but preferably will comprise a mechanical attachment means 34 such as nails or staples driven through the mounting section 20 into the first substrate 12 for affixing them together. Alternatively an adhesive means 32 may be positioned in between the first substrate 12 and the mounting section 20 of sealing member 18 for adhering them together as desired.

In the configuration shown in FIG. 1 the covering section 22 will comprise a V-shaped member 42. This V-shaped member includes a first strut member 44 and a second strut member 46 attached with respect to one another and extending outwardly away from one another to form a V-shape. The first strut member will be secured to the mounting section 20 of the sealing member 10 and the second strut member 46 will comprise the portion of the covering section 22 brought into flexibly resilient engagement with respect to the second substrate 14. As seen in FIG. 1 and as the joint gap 10 changes in size due to independent relative movement between the first substrate 12 and the second substrate 14, the angle between the first strut member 44 and the second strut member 46 will change and, as such, the angle of the V-shaped member 42 will also vary dependent upon whether the joint gap 10 is widening or narrowing. In any case, however, contact between the first strut member 44 and the first substrate 12 will be maintained in contact. This interior angle 56 between the first and second strut members 44 and 46 is an important characteristic of the present invention since it allows continuous contact to be maintained between the second strut member 46 and the second substrate 14 as the two substrates 12 and 14 move independently of one another. A joint of intersection 48 is preferably defined between the V-shaped members which enhances the flexibly thereof. With flexibility at this joint of intersection the first and second struts 44 and 46 of the V-shaped member 42 can be firm, non-flexibly resilient or can be flexibly resilient. This is because since the flexible resilience can be provided by a weakness at the joint of intersection 48 the remaining portions of the V-shaped member 42 can be firm or of limited flexibility.

Figure 2:
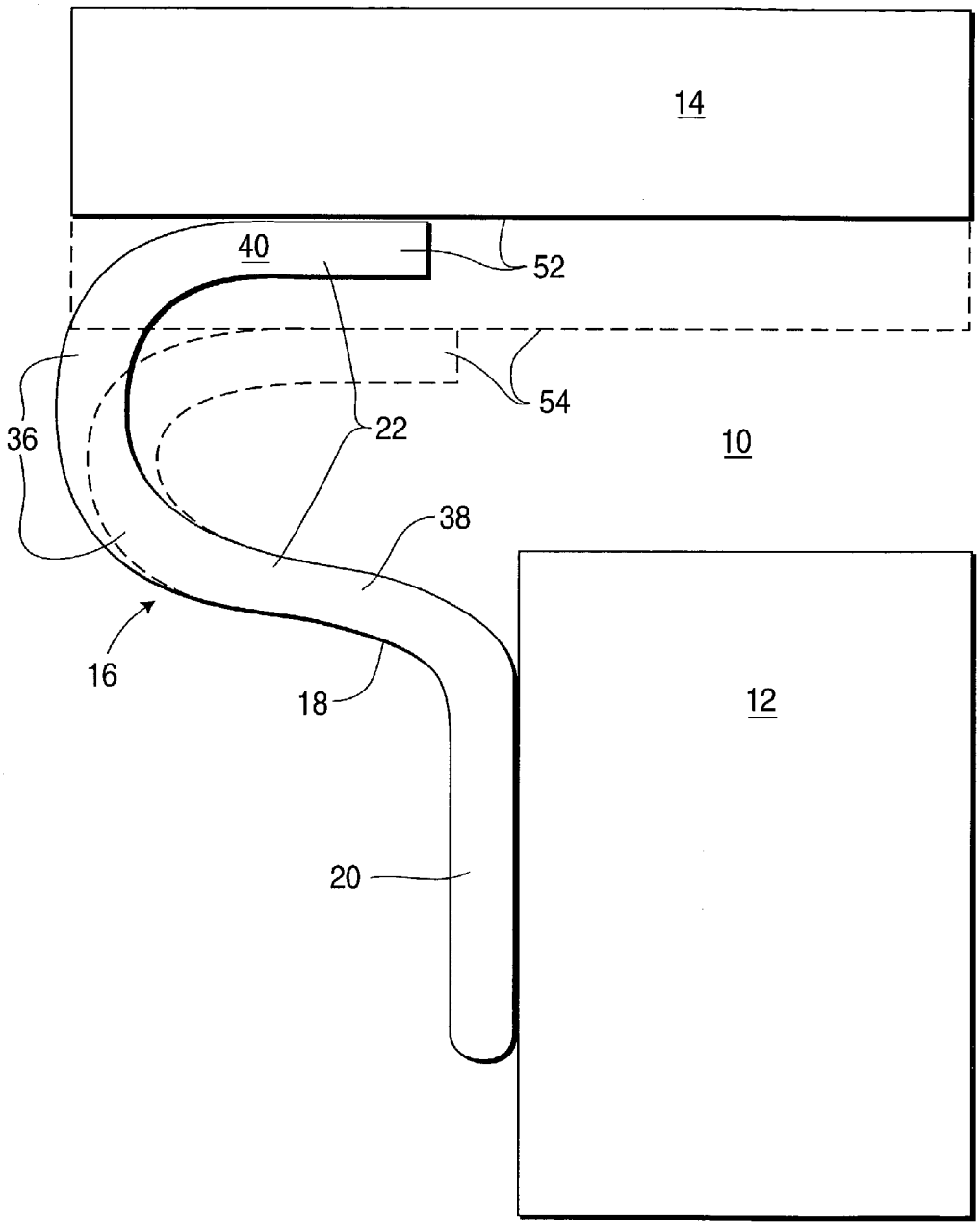
FIG. 2 is a side cross-sectional view of an alternative embodiment of the joint sealing means of the present invention showing a U-shaped covering section shown in full line in the steady state position and in dotted line in a downwardly flexed position.

In a similar manner the U-shaped covering section 36 includes a first leg member 38 and a second leg member 40 extending outwardly away from one another in the form of a U-shape. This design is best shown in FIG. 2. In the steady state position shown by the solid outline drawing in FIG. 2 the first leg member 38 is flexibly biased into contact with the second structural substrate 14 and the first leg member 38 is fixedly secured to the mounting section 20 of the sealing member 18. In this embodiment since the second leg member 40 is flexible and resilient and biased into contact with the second substrate 14, sealing contact will be maintained with respect to the first and second substrates 12 and 14 by the sealing member despite independent relative movement between the two substrates. FIG. 2 shows the U-shaped covering section 36 in the steady state position in solid line but also shows the downwardly flexed position for the second substrate 14 wherein the joint gap 10 is decreased in vertical dimension significantly. This drawing shows also in dotted outline the downwardly flexed position of the second leg member 40 as the secondary position 54 such that contact is maintained and the joint is covered despite the fact that the size of the joint gap 10 has decreased significantly. Note that the initial or steady state position is shown as position 52 in solid line and the secondary or downwardly flexed position is shown in dotted outline by reference numeral 54.

Figure 3:
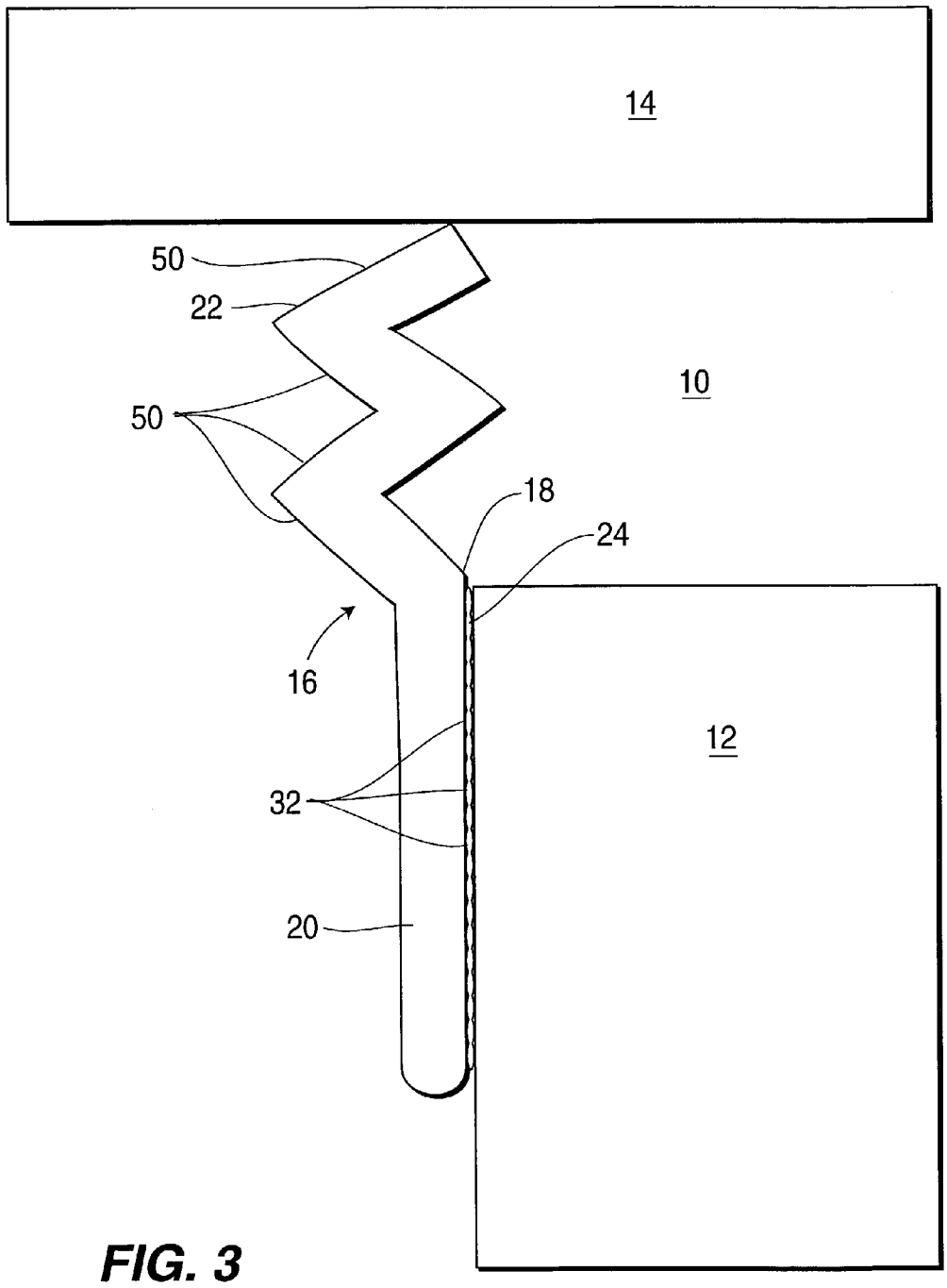
FIG. 3 is a side plan view of another alternative embodiment of the present invention wherein the covering section includes a bellow section.
Figure 5:
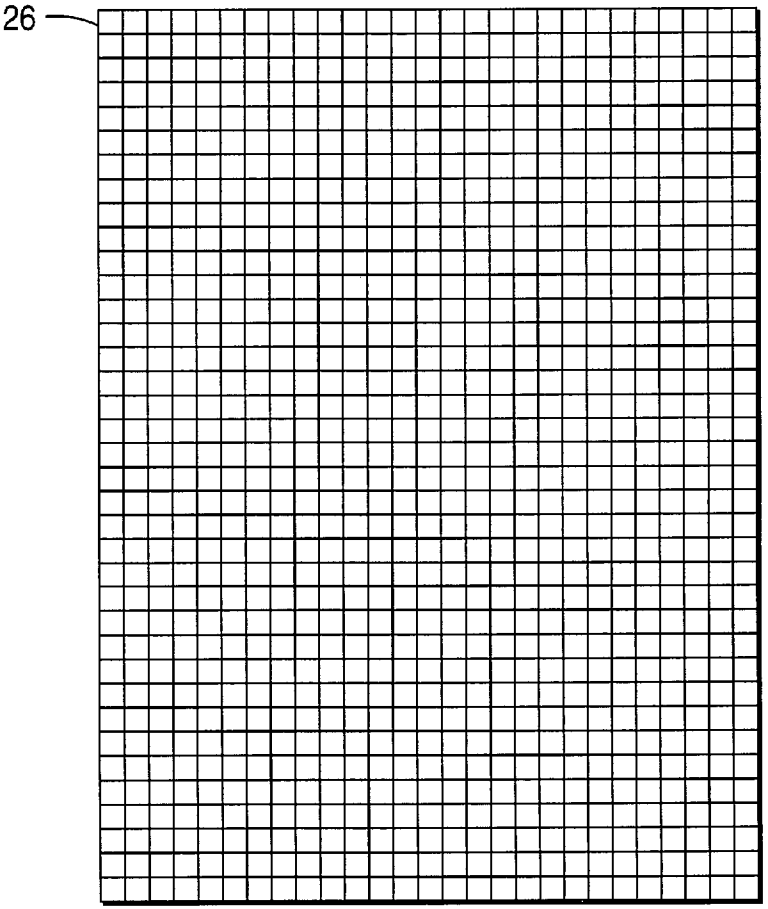
FIG. 5 is a side plan view of the embodiment shown in FIG. 4 taken from the left.
Figure 4:
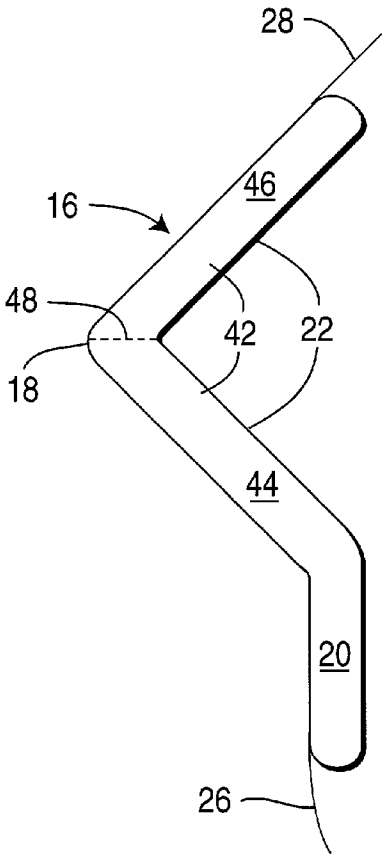
FIG. 4 is a side plan view of the embodiment shown in FIG. 1 with a scrim reinforcing layer secured to the external surface thereof.

A third configuration is shown in FIG. 3 wherein the covering section 22 of the sealing member 18 includes a bellows section 50 which is formed as a bellowing design or accordion-type design to facilitate the flexible resilience of the covering section 22 to maintain it in constant sealing engagement and abutment with respect to the second substrate 14. To further strengthen the overall construction of the joint sealing means 16 of the present invention a scrim material layer 26 may be positioned extending over the external or exposed surface thereof. This scrim means preferably is in the form of some type of screening which can be formed of a metallic or thermoplastic or other similar material which would tend to reinforce or strengthen the surfaces of the joint sealing means 16. Also the scrim material layer 26 can provide a roughened exterior surface to increase the adherence of the external surface of the covering member. This is a significant advantage in those applications where a seal enhancing layer 30 is applied over the sealing member 18 after it is installed to further enhance sealing of the joint gap 10 located therebeneath. The use of a seal enhancing layer 30 is certainly an option with the present invention and is not a requirement. However, when used, it would be a significant advantage if it is used with that construction of the sealing member 18 which includes the scrim material layer 26 since this provides increased adherence to the surface of the sealing member 18 and enhances adherence of the seal enhancing layer 30 thereto.

In a preferred configuration as shown in FIG. 1 the seal enhancing layer 30 may be sprayed or otherwise applied onto the external surface of the joint sealing means 16 in contact with the outer surface of the mounting section and covering section or in contact with the scrim material layer 26 as shown in FIG. 1. This layer can extend beyond the specific boundaries of the sealing member 18 itself onto the areas of the first structural substrate 12 immediately adjacent to the mounting section 20 as well as onto the surface of the second substrate 14 immediately adjacent to the covering section 22 to also more firmly facilitate sealing. When utilized the scrim material layer 26 can include a scrim extension section 28 as shown best in FIG. 1 which specifically extends beyond the point of intersection between the covering section 22 and the second substrate 14 such that the scrim extension layer 28 itself extends over the portion of the second substrate 14 positioned immediately adjacent to the covering section 22. In this manner the seal enhancing layer 30 when applied will adhere directly to the scrim material layer 26 and facilitate sealing thereof against the adjacently positioned second structural substrate 14. It should be appreciated that the use of the scrim material layer 26 and certainly also the scrim extension section 28 is optional and not required. However, it is preferred when the present system is utilized with the otherwise optional seal enhancing layer 30. It should be further appreciated that the seal enhancing layer 30 can, optionally, include an intumescent component to facilitate firestop sealing of the joint gap 10 such that the intumescent component will expand and further enhance sealing of the joint gap 10 responsive to immediately adjacent excessive heat conditions such as a fire or similar heat generating emergency incident.

It should be appreciated that the material of the sealing member 18 can be of any chosen configuration. It needs to be in some manner flexibly resilient which can be achieved through the choice of a material or the structure of the sealing member 18 itself and in particular in the material or structure of the covering section 22 of sealing member 18. For example, the sealing member 18 could be chosen of a galvanized steel construction which has some flexible resilience and can have a mounting section 20 defined thereon which is fixedly secured by a mechanical securement means 34 such as nails or staples for affixing thereof with respect to the first substrate 12. Also the present invention can be usable along with a batting of sealing or insulation material placed in the joint gap 10. However, such material would only be an added supplement and would not be the primary means of maintaining a seal over the joint gap 10.

It should be appreciated that the present invention provides a predetermined shaped molded product which, although being flexibly resilient, has a predetermined molded shape designed specifically to allow sealing of the joint gap 10 while allowing fixed securement of the sealing system to only one of the two adjacent substrates and not both. The present invention also is designed for fire rated situations or non-fire related standard applications which are often required in areas such as head-of-wall sealing wherein fire sealing is not something specifically required. This type of requirement is often experienced, however of course, the present invention could be used in any fire rated joint sealing application.

The present invention is particularly adaptable for sealing various types of joint gaps since when utilizing the V or U-shaped configuration the angle between the outwardly extending legs or struts can be varied in order to vary the size of gap with which the sealing system is usable. The size needs to be increased sufficiently that the portion of the covering section 22 in abutment with the second substrate 14 will be biased thereagainst when the mounting section 22 is fixedly secured to the first substrate 12 thereadjacent.

One of the important objects of the present invention is to avoid the situation where the first and second substrates are firmly bonded to one another. This type of firm bonding does sometimes occur even when merely a sealing mechanism is placed extending therebetween. This problem is commonly referred to as "three-sided adhesion" or "three-point adhesion". When a sealing mechanism is placed in the joint gap 10 and is firmly secured to both sides it is basically restricting the capability of the first and second substrates 12 and 14 moving independently of one another. This independent movement is sometimes very important to allow for thermal or other expansion or contraction as well as normal flexing of the walls, ceilings and floors of conventional building structures. The avoidance of such three-sided adhesion is an important advantage of the present invention.

These types of systems often require the use of very elastic caulking or coating compounds and the forces causing the joint to become larger and smaller over time force these caulking or coating materials to elongate. In this manner these elongated materials often cannot handle the amount of movement required on a regular basis. As such, this lack of flexibility tends to become more critical over time because of the tendency of such elastic caulking and coating materials to continue to cure over extensive periods of time.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A method for sealing a joint gap defined between a first structural substrate and a second structural substrate which are independently movable relative to one another, said method comprising:

A. providing of a sealing member having a mounting section and a flexibly resilient covering section defined thereon;

B. placing the flexibly resilient covering section into abutment with the second structural substrate without permanent securement therebetween;

C. compressing the flexibly resilient covering section by deforming thereof at least partially against the abutting second structural substrate member to facilitate sealing engagement therebetween without permanent securement therebetween;

D. fixedly and permanently securing the mounting section of the sealing member in direct abutting contact with respect to the first structural substrate while maintaining the flexibly resilient covering section deformed and biased into abutment against the second structural substrate member without permanent securement therebetween for sealing between the first structural substrate and the second structural substrate at all times including during independent relative movement therebetween;

E. applying of a scrim material layer across the outwardly facing surface of the mounting section and the coveting section of the sealing member for reinforcing thereof, said applying of a scrim material layer including applying an extension section extending beyond the end of the covering section to extend outwardly therefrom over at least a portion of the second structural substrate; and F. applying of a layer of sealing composition over the sealing member and the scrim member to facilitate sealing against the adjacently positioned first and second structural substrate members, said applying of a layer of sealing composition being performed with a sealing composition that includes an intumescent component to facilitate sealing of the gap between the first and second structural substrates responsive to conditions of extreme heat.

2. A method for sealing a joint gap defined between a first structural substrate and a second structural substrate which are independently movable relative to one another as defined in claim 1 wherein said fixedly and permanently securing the mounting section of the sealing member comprises mechanically fastening of the mounting section with respect to the first structural substrate.

3. A method for sealing a joint gap defined between a first structural substrate and a second structural substrate which are independently movable relative to one another as defined in claim 2 wherein said mechanical fastening of the mounting section with respect to the first structural substrate comprises driving a stapling member through the mounting section into the first structural substrate.

4. A method for sealing a joint gap defined between a first structural substrate and a second structural substrate which are independently movable relative to one another as defined in claim 1 wherein said fixedly and permanently securing of the mounting section of the sealing member comprises positioning an adhesive between the mounting section and the first structural substrate for achieving adhesion therebetween.

5. A method for sealing a joint gap defined between a first structural substrate and a second structural substrate which are independently movable relative to one another as defined in claim 1 wherein said providing of a sealing member is performed with the covering section and the mounting section formed integrally as a single unit.

6. A method for sealing a joint gap defined between a first structural substrate and a second structural substrate which are independently movable relative to one another as defined in claim 1 wherein said providing of a sealing member is performed with a covering section having a U-shaped configuration to facilitate flexible biasing thereof against the second structural member for facilitating sealing thereagainst.

7. A method for sealing a joint gap defined between a first structural substrate and a second structural substrate which are independently movable relative to one another as defined in claim 1 wherein said providing of a sealing member is performed with the covering section having a V-shaped configuration to facilitate flexible biasing thereof against the second structural member for facilitating sealing thereagainst.

8. A method for sealing a joint gap defined between a first structural substrate and a second structural substrate which are independently movable relative to one another as defined in claim 1 wherein said providing of a sealing member is performed with the covering section having a bellows-shaped section to facilitate flexible biasing thereof against the second structural member for sealing thereagainst.

9. A joint sealing means positionable extending over a joint gap defined between a first structural substrate and a second structural substrate which are independently movable and adjacently positioned, said joint sealing means including A. a sealing member being flexible and preformed into a predetermined shape, said sealing member including:

(1) a mounting section positional in abutment with respect to the first structural substrate and adapted to be attached permanently with respect thereto for sealing engagement therewith;

(2) a covering section made of flexibly resilient material and attached with respect to said mounting section and extending outwardly therefrom away from the first structural substrate and toward the second structural substrate and into abutting contact therewith without being permanently secured thereto, said mounting section of said sealing member and said covering section thereof being a single integrally formed unit, said covering section being flexibly resilient and preformed into a predetermined shape, said covering section adapted to extend from said mounting section outwardly toward the second structural substrate into flexibly resilient abutting engagement therewith without being permanently secured thereto to facilitate sealing engagement thereagainst for facilitating maintaining sealing engagement therewith during independent relative movement between the first and second structural substrates;

B. a securement means for fixedly and permanently securing said mounting section of said sealing member with respect to the first structural substrate;

C. a scrim means extending over said mounting section and said covering section of said sealing member to facilitate sealing of the joint gap between the first structural substrate and the second structural substrate, said scrim means being affixed to said mounting section and said covering section of said sealing member to facilitate securement thereof to the first structural substrate and sealing thereof with respect to the second structural substrate, said scrim means extending outwardly beyond said covering section of said sealing member to facilitate sealing thereof with respect to the second structural substrate, said scrim means extending over said mounting section and over and outwardly beyond said covering section of said sealing member to facilitate sealing of the joint gap between the first structural substrate and the second structural substrate; and D. a seal enhancing layer applied extending over said sealing member on top of said scrim means to facilitate sealing of the gap between the first structural substrate and the second structural substrate, said seal enhancing layer including an intumescent material component therein to further facilitate sealing of the gap between the first structural substrate and the second structural substrate responsive to a excessive heat, adherence of said seal enhancing layer to said mounting section and said covering section being enhanced by engagement thereof to said scrim means extending thereover and adjacent to the second structural substrate.

10. A joint sealing means positionable extending over a joint gap defined between a first structural substrate and a second structural substrate which are independently movable and adjacently positioned as defined in claim 9 wherein said securement means includes an adhesive means positioned upon said mounting section of said sealing member to facilitate fixed securement thereof with respect to the first structural substrate.

11. A joint sealing means positionable extending over a joint gap defined between a first structural substrate and a second structural substrate which are independently movable and adjacently positioned as defined in claim 9 wherein said securement means includes a mechanical attachment means positionable extending through said mounting section of said sealing member into the first structural substrate to fixedly secure said mounting section with respect to the first structural substrate.

12. A joint sealing means positionable extending over a joint gap defined between a first structural substrate and a second structural substrate which are independently movable and adjacently positioned as defined in claim 9 wherein said mounting section of sail sealing member and said covering section thereof are a single integrally formed unit.

13. A joint sealing means positionable extending over a joint gap defined between a first structural substrate and a second structural substrate which are independently movable and adjacently positioned as defined in claim 9 wherein said covering section of said sealing member is U-shaped and is flexibly resilient to facilitate flexing thereof relative to the second structural substrate to facilitate maintaining sealing engagement between said covering section and the second structural substrate during independent relative movement therebetween.

14. A joint sealing means positionable extending over a joint gap defined between a first structural substrate and a second structural substrate which are independently movable and adjacently positioned as defined in claim 13 wherein said covering section further includes:

A. a first leg member attached with respect to said mounting section and extending outwardly therefrom; and B. a second leg member attached to said first leg member and extending outwardly spatially disposed therefrom into flexibly biased sealing engagement with respect to the second structural substrate to facilitate extending of said covering section over the gap defined between the first and second structural substrates.

15. A joint sealing means positionable extending over a joint gap defined between a first structural substrate and a second structural substrate which are independently movable and adjacently positioned as defined in claim 9 wherein said covering section of said sealing member is V-shaped and is flexibly resilient to facilitate flexing thereof with respect to the second structural substrate and to facilitate maintaining sealing engagement therebetween during independent relative movement between the first a second structural substrates.

16. A joint sealing means positionable extending over a joint gap defined between a first structural substrate and a second structural substrate which are independently movable and adjacently positioned as defined in claim 15 wherein said coveting section further includes:

A. a first strut member extending outwardly and attached with respect to said mounting section; and B. a second strut member attached with respect to said first strut member and extending spatially disposed outwardly therefrom to form said covering section into a V-shape, said second strut member extending outwardly into sealing engagement with respect to the second structural substrate to facilitate extending of said covering section over the gap defined between the first and second structural substrates.

17. A joint sealing means positionable extending over a joint gap defined between a first structural substrate and a second structural substrate which are independently movable and adjacently positioned as defined in claim 16 wherein said covering section further includes a joint of intersection with said first strut member attached thereto and with said second strut member also being attached thereto, said second strut member extending outwardly to a position spatially disposed from said first strut member, said joint of intersection being flexibly resilient to provide flexible resilience between said first strut member and said second strut member of said covering section which is V-shaped and to provide flexible resilience in biasing of said second strut member against the second structural substrate and to facilitate maintaining sealing engagement therebetween during independent relative movement between the first and second structural substrates.

18. A joint sealing means positionable extending over a joint gap defined between a first structural substrate and a second structural substrate which are independently movable and adjacently positioned as defined in claim 9 wherein said covering section of said sealing member includes a bellows section which is flexibly resilient to facilitate biasing thereof against the second structural substrate for sealing engagement therewith responsive to independent movement between the first and second structural substrates.

* * * * *

UNITED STATES PATENT AND TRADEMARK OFFICE

CERTIFICATE OF CORRECTION

PATENT NO. : 7,240,905 B1
APPLICATION NO. : 10/461813
DATED : July 10, 2007
INVENTOR(S) : James P. Stahl, Sr.

It is certified that error appears in the above-identified patent and that said Letters Patent is hereby corrected as shown below:

In column 9, line 20 change “coveting” to -- covering --.

In column 12, line 19, change “coveting” to -- covering --.

Signed and Sealed this

Fifteenth Day of April, 2008

JON W. DUDAS
*Director of the United States Patent and Trademark Office*